United States Patent [19]

McKay et al.

[11] 4,166,806

[45] Sep. 4, 1979

[54] CRACKING CATALYST PASSIVATED WITH A CRUDE ANTIMONY PHOSPHORODITHIOATE

[75] Inventors: Dwight L. McKay; Brent J. Bertus, both of Bartlesville, Okla.

[73] Assignee: Phillips Petroleum Company, Bartlesville, Okla.

[21] Appl. No.: 926,699

[22] Filed: Jul. 25, 1978

[51] Int. Cl.[2] ..... C10G 11/06; B01J 8/24; B01J 21/21

[52] U.S. Cl. ..... 252/437; 208/48 AA; 208/114; 252/417; 252/439; 252/464; 423/617; 260/446

[58] Field of Search ..... 208/48, 113, 114–121; 252/415–418, 436, 437, 439, 456, 464, 477 R, 411; 260/446; 423/617

[56] References Cited

U.S. PATENT DOCUMENTS

| | | | |
|---|---|---|---|
| 2,129,693 | 9/1938 | Houdry | 208/119 |
| 2,921,018 | 1/1960 | Helmers et al. | 208/114 |
| 3,506,567 | 4/1970 | Barger et al. | 208/89 |
| 3,711,422 | 1/1973 | Johnson et al. | 252/414 |
| 3,979,472 | 9/1976 | Butter | 260/668 R |
| 4,025,458 | 5/1977 | McKay | 252/416 |
| 4,031,002 | 6/1977 | McKay | 208/113 |
| 4,036,740 | 7/1977 | Readal et al. | 208/120 |
| 4,111,845 | 9/1978 | McKay | 208/120 |

*Primary Examiner*—Delbert E. Gantz
*Assistant Examiner*—G. E. Schmitkons

[57] ABSTRACT

A hydrocarbon cracking catalyst is treated with a crude antimony tris-(O,O-dihydrocarbyl phosphorodithioate) to passivate thereon contaminating metals, e.g., vanadium, iron and/or nickel. Used or unused catalyst can be treated.

4 Claims, No Drawings

CRACKING CATALYST PASSIVATED WITH A CRUDE ANTIMONY PHOSPHORODITHIOATE

This invention relates to cracking of a hydrocarbon. In one of its aspects it relates to passivating a contaminating metal on a hydrocarbon cracking catalyst. In another of its aspects the invention relates to a process for cracking hydrocarbon, e.g., a hydrocarbon oil, with a catalyst which has been treated to passivate a contaminating metal whenever it appears thereon.

U.S. Pat. No. 3,711,422, Marvin M. Johnson and Donald C. Tabler, Jan. 16, 1973, discloses and claims restoring the activity of a cracking catalyst with a compound of antimony, e.g., antimony triphenyl. U.S. Pat. Nos. 4,025,458, May 24, 1977 and 4,031,002, June 21, 1977, Dwight L. McKay, disclose and claim passivating metals on cracking catalysts with antimony compounds which are phosphorodithioates, as described in the patents.

As used herein and in the claims, the term "crude antimony tris(O,O-dihydrocarbyl phosphorodithioate)" describes a crude or unfinished material or product comprising an antimony tris(O,O-dihydrocarbyl phosphorodithiate) prepared by, and resulting from, the reaction of an O,O-dihydrocarbyl phosphorodithioic acid with antimony trioxide in a hydrocarbon diluent, optionally with removal of by-product water, without filtration, centrifugation, decantation, or other technique to remove solid impurities such as residual antimony trioxide and without the application of any other technique to effect stabilization of the antimony tris(O,O-dihydrocarbyl phosphorodithioate). Thus, the crude antimony tris(O,O-dihydrocarbyl phosphorodithioate) is produced by, and results from, the reaction of an O,O-dihydrocarbyl phosphorodithioic acid with antimony trioxide approximately in the stoichiometric molar ratio of 3:1, or slight higher, in a liquid hydrocarbon diluent, e.g., hexane, heptane, octane, decane, dodecane, gasoline, kerosene, mineral oil, cyclohexane, methylcyclopentane, benzene, toluene, xylenes, or the like, preferably using within the range of about 0.1 to about 3 parts by weight diluent per part by weight theoretical amount of antimony tris(O,O-dihydrocarbyl phosphorodithioate) produced, without the application of subsequent steps to purify the resulting composition except for the optional removal of water by any distillation method, which can coincidentally effect the removal of at least a portion of other relatively volatile substances, e.g., hydrocarbon diluent or hydrogen sulfide. Although the reaction conditions for the synthesis can vary over a wide range, generally the synthesis is conducted at a temperature within the range of about 10° C. to about 50° C. for a period of time within the range of about 5 minutes to about 2 hours at a pressure sufficient to maintain the diluent substantially in the liquid phase. The term "crude antimony tris(O,O-dipropyl phosphorodithioate)," as used herein, refers to a composition within the scope of crude antimony tris(O,O-dihydrocarbyl phosphorodithioate)s, as defined above, wherein the hydrocarbyl groups are propyl radicals.

As used herein, the term "purified antimony tris(O,O-dihydrocarbyl phosphorodithioate)" describes a product obtained after the crude antimony tris(O,O-dihydrocarbyl phosphorodithioate) composition or reaction product has been subjected to stabilization and solids removal treatment, such as by filtration, centrifugation, or decantation. Preferably, filtration using a filter aid such as diatomaceous earth or perlite is employed. The term "purified antimony tris(O,O-dipropyl phosphorodithioate)," as used herein, refers to a composition within the scope of purified antimony tris(O,O-dihydrocarbyl phosphorodithioate)s, as defined above, wherein the hydrocarbyl groups are propyl radicals.

The antimony tris(O,O-dihydrocarbyl phosphorodithioate) which is an essential component of the crude antimony tris(O,O-dihydrocarbyl phosphorodithioate) used in this invention can be any one or more of the antimony tris(O,O-dihydrocarbyl phosphorodithioate)s described in U.S. Pat. Nos. 4,025,458 and 4,031,002, the disclosures of which are incorporated herein by reference. Thus, applicable antimony tris(O,O-dihydrocarbyl phosphorodithioate)s are those as described in said patents and can be represented by the formula $[(RO)_2PS_2]_3Sb$, wherein the R goups, which can be the same or different, are hydrocarbyl radicals, each containing from 1 to about 18 carbon atoms per radical, the total number of carbon atoms per molecule being from 6 to about 90. Examples of radicals are alkyl, cycloalkyl and aryl and combinations thereof, e.g., alkaryl and aralkyl.

Examples of some antimony tris(O,O-dihydrocarbyl phosphorodithioate)s which can be used include antimony tris(O,O-dimethyl phosphorodithioate), antimony tris(O,O-diethyl phosphorodithioate), antimony tris(O,O-dipropyl phosphorodithioate), antimony tris(O,O-diisobutyl phosphorodithioate), antimony tris(O,O-dihexyl phosphorodithioate), antimony tris]O,O-bis(2-ethyloctyl)phosphorodithioate], antimony tris(O,O-dipentadecyl phosphorodithioate), antimony tris(O-octadecyl O-cyclohexyl phosphorodithioate), antimony tris(O,O-dicyclohexyl phosphorodithioate), antimony tris]O,O-bis(3-methylcyclopentyl)phosphorodithioate], antimony tris]O,O-bis(cyclopentylmethyl)phosphorodithioate], antimony tris(O,O-diphenyl phosphorodithioate), antimony tris(O,O-di-p-tolyl phosphorodithioate), antimony tris(O,O-dibenzyl phosphorodithioate), antimony tris(O-butyl O-phenyl phosphorodithioate), and the like, and mixtures thereof. Antimony tris(O,O-dipropyl phosphorodithioate) is the antimony tris(O,O-dihydrocarbyl phosphorodithioate) presently preferred.

In the claims, the given formula as above further described preceded by the word "crude" is intended to identify materials produced as described in preceding paragraphs of this disclosure.

In one of its concepts the invention provides a catalyst composition which has been treated by addition thereto of a crude antimony tris(O,O-dihydrocarbyl phosphorodithioate). In another of its concepts the invention provides a method for passivating a contaminating metal, e.g., vanadium, iron and/or nickel, on a catalyst by adding at least one crude antimony compound described herein, to said catalyst, whether used or unused. In a further concept of the invention it provides a catalytic cracking operation suited for the beneficiation of a hydrocarbon, e.g., a hydrocarbon oil, which comprises contacting the catalyst, used or unused, with at least one crude antimony compound described herein.

Cracking catalysts, when used to crack oil that contains metals, e.g., vanadium, iron and nickel, accumulate a deposit of these metals. This decreases the yield of gasoline and increases the yield of hydrogen and coke. As known, hydrocarbon feedstock containing higher molecular weight hydrocarbons is cracked by contacting it at an elevated temperature with a cracking catalyst to produce light distillates such as gasoline. The cracking catalyst gradually deteriorates during the cracking operation. A reason for this deterioration is the deposition of contaminating metals such as vanadium, iron and/or nickel on the catalyst. This results in the earlier mentioned disadvantages and also, usually, in a decreased conversion of the hydrocarbon into gasoline.

When the very large amounts of hydrocarbon processed, the high percentage of oil needs of our Country which are now imported and the potential shortage of oil in the world are considered, it is seen that any improvement in the affected results of catalytic cracking of hydrocarbon can be significant. Therefore, there is a need for a cracking process which will prevent or at least reduce significantly at least some of the deleterious effects of the above-mentioned metal contaminants.

It is an object of this invention to passivate a contaminating metal on a cracking catalyst. It is another object of this invention to provide a catalyst which has been treated to passivate a contaminating metal, e.g., vanadium, iron and/or nickel, thereon whenever it appears on said catalyst. It is a further object of the invention to provide a hydrocarbon cracking operation in which metals tending to contaminate catalyst, thereby reducing its effectiveness or efficiency, are passivated. It is a further object of the invention to provide a method for passivating a metal on a cracking catalyst which contaminates the same whenever it is contaminating the same. According to the present invention, contaminating metals, e.g., vanadium, iron and/or nickel, deposited on the catalyst, e.g., a cracking catalyst, suitable for cracking hydrocarbon, e.g., hydrocarbon oil, are passivated thereon whenever they appear by treating the catalyst to add thereto a crude antimony compound as defined herein.

The catalyst treated can be a used or unused one.

Also, according to the invention, there is provided a method for treating a catalyst suitable for hydrocarbon conversion which comprises adding to said catalyst a crude antimony compound as described herein.

Still further according to the invention, there is provided a catalytic cracking operation suitable for cracking hydrocarbon oil which comprises applying to the catalyst, used or unused, a crude antimony compound as described herein.

When the catalyst is an unused cracking catalyst it is treated with the crude antimony compound to reduce its susceptibility to the deleterious effects of later-deposited contaminating metal: vanadium, iron and/or nickel.

In accordance with this invention, a new or used conventional cracking catalyst is contacted, as described below, with at least one crude antimony tris-(O,O-dihydrocarbyl phosphorodithioate) to provide an antimony-containing cracking catalyst which is useful as a catalyst in the cracking of hydrocarbons containing contaminating metals such as nickel, vanadium, and iron, the antimony in the catalyst serving to at least partially overcome the deleterious effects of the contaminating metals, regardless of whether these contaminating metals are present on the catalyst prior to contacting the catalyst with the crude antimony tris(O,O-dihydrocarbyl phosphorodithioate) or the contaminating metals are deposited from the metals-containing hydrocarbon feedstock onto the antimony-containing catalyst. For example, it has been demonstrated that in a process for cracking topped crude oil containing metal contaminants a metals-contaminated cracking catalyst to which antimony has been added in the form of crude antimony tris(O,O-dipropyl phosphorodithioate), as described below, provides more gasoline, less coke, and less hydrogen than a comparable catalyst to which no antimony has been added, and provides even more gasoline and even less coke than a comparable catalyst to which antimony has been added in the form of purified antimony tris(O,O-dipropyl phosphorodithioate), as described below.

The cracking catalyst which is contacted with the crude antimony compound can be any of those which are conventionally employed in the cracking of hydrocarbons boiling above about 400° F. (204° C.) for the production of gasolines, motor fuel blending components and light distillates. These catalysts generally contain silica or silica-alumina, such materials frequently being associated with zeolitic materials. These zeolitic materials can be naturally occurring, or they can be produced by conventional ion exchange methods so as to provide metallic ions which improve the activity of the catalyst. Rare earth metals, including cerium, are frequently used for this purpose. Zeolite-modified silica-alumina catalysts are particularly applicable. Examples of cracking catalysts into or onto which the crude antimony compound can be incorporated include hydrocarbon cracking catalysts obtained by admixing an inorganic oxide gel with an aluminosilicate and aluminosilicate compositions which are strongly acidic as a result of treatment with a fluid medium containing at least one rare earth metal cation and a hydrogen ion or ion capable of conversion to a hydrogen ion. If desired, the cracking catalyst can contain a combustion promoter such as platinum or chromium.

The manner in which the conventional cracking catalyst is contacted with the crude antimony compound is not critical. For example, the crude antimony compound can be mixed with the conventional cracking catalyst in ordinary manner such as rolling, shaking, stirring, or the like, followed by volatilization of diluent, if present. Alternatively, the crude antimony compound can be dissolved or dispersed in a suitable liquid, e.g., water or hydrocarbon, and the resulting solution or dispersion can be used to impregnate the conventional cracking catalyst, followed by volatilization of the liquid. If desired, the crude antimony compound can be dissolved or dispersed in the hydrocarbon feedstock to the cracking process, in which instance the hydrocarbon feedstock and the crude antimony compound contact the cracking catalyst at about the same time.

Although the ratio of crude antimony compound to conventional cracking catalyst can vary over a wide range, depending in part on the concentration of contaminating metals in the catalyst and in the hydrocarbon feedstock to be cracked, the crude antimony compound generally will be used in an amount such as to provide within the range of about 0.002 to about 5, preferably about 0.01 to about 1.5, parts by weight antimony per 100 parts by weight conventional cracking catalyst, i.e., including any contaminating metals in the catalyst but excluding the crude antimony compound.

The cracking process in which the antimony-containing cracking catalyst is employed is basically an improvement over a conventional cracking process which employs a conventional cracking catalyst. Although the antimony-containing cracking catalyst can be employed in a catalytic cracking process employing a fixed catalyst bed, it is especially useful in a fluid catalytic cracking process.

A preferred embodiment of the cracking process of this invention utilizes a cyclic flow of catalyst from a cracking zone to a regeneration zone. In this process a hydrocarbon feedstock containing contaminating metals such as vanadium, iron and/or nickel, is contacted in a cracking zone under cracking conditions and in the absence of added hydrogen with an antimony-containing cracking catalyst produced by use of a crude antimony compound as described above; a cracked product is obtained and recovered; the cracking catalyst is passed from the cracking zone into a regeneration zone; and in the regeneration zone the cracking catalyst is regenerated by contacting the cracking catalyst with a free oxygen-containing gas, preferably air. The coke that has been built up during the cracking process is thereby at least partially burned off the catalyst. The regenerated cracking catalyst is reintroduced into the cracking zone.

Furthermore, it is preferred in carrying out the cracking process of this invention to replace a fraction of the total cracking catalyst by unused cracking catalyst continuously or intermittently. Generally, about 0.5 to about 6 weight percent of the total cracking catalyst is replaced daily by a fresh cracking catalyst. The actual quantity of the catalyst replaced depends in part upon the nature of the feedstock used. The makeup quantity of cracking catalyst can be added at any location in the process. Preferably, however, the cracking catalyst that is makeup catalyst is introduced into the regenerator in a cyclic cracking process.

Also, it is to be understood that the used cracking catalyst coming from the cracking zone, before introduction into the regenerator, is stripped of essentially all entrained liquid or gaseous hydrocarbons. Similarly, the regenerated catalyst can be stripped of any entrained oxyygen before it reenters the cracking zone. The stripping is generally done with steam.

The specific conditions in the cracking zone and in the regeneration zone depend upon several parameters such as the feedstock used, the catalyst used, and the results desired. Preferably and most commonly, the cracking and regeneration conditions are or will be within the following ranges:

| Cracking Zone: | |
|---|---|
| Temperature: | 800° F. to 1200° F. (427° C. to 649° C.) |
| Time: | 1–40 seconds |
| Pressure: | Subatmospheric to 3,000 psig |
| Catalyst:Oil Ratio: | 3:1 to 30:1, by weight |

| Regeneration Zone: | |
|---|---|
| Temperature: | 1000° F. to 1500° F. (538° C. to 816° C.) |
| Time: | 2–70 minutes |
| Pressure: | Subatmospheric to 3,000 psig |
| Air @ 60° F. (16° C.) and 1 atm: | 100–250 $ft^3$/lb coke (6.2–15.6 $m^3$/kg coke) |

The feedstocks employed in the catalytic cracking process of this invention contain metal contaminants such as nickel, vanadium, and iron. The feedstocks include those which are conventionally utilized in catalytic cracking processes to produce gasoline and light distillate fractions from heavier hydrocarbon feedstocks. The feedstocks have an initial boiling point above about 400° F. (204° C.) and include fluids such as gas oils, fuel oils, topped crudes, shale oils, oils from tar sands, oils from coal, mixtures of two or more of these, and the like. By "topped crude" is meant those oils which are obtained as the bottoms of a conventional crude oil fractionator. Such topped crudes are crudes from which the lighter and readily distillable portions have been removed, or even a vacuum-reduced crude oil. If desired, all or a portion of the feedstock can constitute an oil from which a portion of the metal content previously has been removed, e.g., by hydrotreating or solvent extraction.

Typically the feedstock utilized in the process of this invention will contain one or more of the metals nickel, vanadium, and iron within the ranges shown in Table I.

Table I

| Metal | Metal Content of Feedstock, ppm(1) |
|---|---|
| Nickel | 0.02 to 100 |
| Vanadium | 0.02 to 500 |
| Iron | 0.02 to 500 |
| Total metals | 0.2 to 1100(2) |

(1)The ppm metal content refers to the feedstock as used.
(2)Total metals in this table and elsewhere refer to the sum of the nickel, vanadium, and iron contents in the feedstock that are effective in contaminating the catalyst; the total metals content can be determined in accordance with methods well known in the art, e.g., by atomic absorption spectroscopy.

One of the most important embodiments of this invention resides in a heavy oil cracking process. The known commercial heavy oil cracking process is capable of cracking heavy oil having a metals content of up to 80 ppm of total effective metals, i.e., metals in any form detrimental to the cracking process. Economically marginal results are obtained with oils having 40 to 80 ppm of total effective metals. In accordance with this invention, heavy oils with a total metals content of about 40 to 100 ppm and even those of about 100 to 200 ppm and above of total metals can be cracked in a cracking process in the absence of added hydrogen by utilizing the cracking catalyst defined above to yield gasoline and other fuels and fuel blending components. Thus, known heavy oils with total metals contents from 80 to 300 ppm that heretofore could not be directly used for fuel production and in particular for gasoline production in accordance with this invention can be cracked to yield gasoline and other fuel blending components. Most preferably the concentration of antimony in the antimony-containing cracking catalyst used in the process of this invention for cracking these heavily metal-loaded oils is related to the average total effective metals content of the feedstock as shown in Table II.

Table II

| Total Effective Metals in Feedstock, ppm | Antimony Concentration in Catalyst, Weight %(1) |
|---|---|
| 40–100 | 0.05–0.8 |
| 100–200 | 0.1–1 |
| 200–300 | 0.15–1.5 |
| 300–800 | 0.2–2 |

(1)Based on weight of catalyst prior to addition of the crude antimony tris(0,0-dihydrocarbyl phosphorodithioate).

EXAMPLE

A commercial cracking catalyst comprising amorphous silica-alumina associated with zeolitic material, which had been used in a commercial cracking unit and subsequently subjected to regeneration in the laboratory was employed in tests which demonstrated the value of using crude antimony tris(O,O-dipropyl phosphorodithioate) in improving a cracking catalyst contaminated with metals detrimental to a cracking process. Properties of the used cracking catalyst prior to regeneration in the laboratory are shown in Table III.

Table III

| | |
|---|---|
| Surface area, $m^2/g$ | 74.3 |
| Pore volume, ml/g | 0.29 |
| Composition, weight % | |
| Aluminum | 21.7 |
| Silicon | 24.6 |
| Nickel | 0.38 |
| Vanadium | 0.60 |
| Iron | 0.90 |
| Cerium | 0.40 |
| Sodium | 0.39 |
| Carbon | 0.06 |

The used commercial cracking catalyst having the properties shown in Table III was then subjected to regeneration in the laboratory by heating the catalyst while fluidized with air to 1200° F. (649° C.) and maintaining it at that temperature for about 0.5 hour while fluidized with air. The catalyst was then cooled to room temperature (about 25° C.) while fluidized with nitrogen, and the resulting catalyst, herein designated as catalyst O, was employed as shown below.

Two portions of catalyst O were used in the preparation of compositions containing 0.11 and 0.54 parts by weight, respectively, of antimony per 100 parts by weight catalyst O, the antimony being employed as crude antimony tris(O,O-dipropyl phosphorodithioate). This crude antimony tris(O,O-dipropyl phosphorodithioate), prepared by the reaction of O,O-dipropyl phosphorodithioic acid with antimony trioxide in a hydrocarbon solvent comprising mineral oil, followed by removal of by-product water, was an amber liquid containing mineral oil, this amber liquid analyzing as 11.9 weight percent antimony, 19.7 weight percent sulfur, and 10.1 weight percent phosphorus, and having a density of 1.25 g/ml and a viscosity at 210° F. (99° C.) greater than 46 SUS. In the preparation of the compositions containing 0.11 and 0.54 parts by weight antimony per 100 parts by weight catalyst O, 0.36 ml and 1.82 ml, respectively, of the crude antimony tris(O,O-dipropyl phosphorodithioate) described above in 60 ml of cyclohexane were stirred into 50 g of catalyst O, previously dried in a fluid bed at 900° F. (482° C.). In each instance the resulting wet brown slurry was dried on a hot plate at 500° F. (260° C.) to give a fine powder. The powder was transferred to a quartz reactor and heated to 900° F. (482° C.) as a bed fluidized with nitrogen, then heated to 1200° F. (649° C.) while fluidized with hydrogen, then purged with nitrogen for 5 minutes, and then purged with air for 15 minutes. The resulting catalyst composition was then preaged by processing it through ten reducing-oxidizing cycles wherein in each cycle the catalyst composition was cooled from 1200° F. (649° C.) to about 900° F. (482° C.) during 0.5 minutes while fluidized with air, then maintained at 900° F. (482° C.) for 1 minute while fluidized with nitrogen, then heated to 1200° F. (649° C.) during 2 minutes while fluidized with hydrogen, then maintained at 1200° F. (649° C.) for 1 minute while fluidized with nitrogen, and then maintained at 1200° F. (649° C.) for 10 minutes while fluidized with air. The catalyst composition was then cooled to room temperature (about 25° C.) while fluidized with nitrogen. The resulting catalyst containing 0.11 part by weight antimony per 100 parts by weight catalyst O used in its preparation is herein designated as catalyst A-1, and the resulting catalyst containing 0.54 part by weight antimony per 100 parts by weight catalyst O is herein designated as catalyst A-2.

Two additional portions of catalyst O were used in the preparation of compositions containing 0.10 and 0.50 parts by weight, respectively, of antimony per 100 parts by weight catalyst O, the antimony being employed as purified antimony tris(O,O-dipropyl phosphorodithioate). This purified antimony tris(O,O-dipropyl phosphorodithioate), prepared by the reaction of O,O-dipropyl phosphorodithioic acid with antimony trioxide in a hydrocarbon solvent comprising mineral oil, followed by removal of by-product water and filtration to remove insoluble impurities and aid in stabilization of the antimony tris(O,O-dipropyl phosphorodithioate), was an amber liquid containing mineral oil, this amber liquid analyzing as 10.9 weight percent antimony, 19.4 weight percent sulfur, and 9.05 weight percent phosphorus, and having a density of 1.2 g/ml and a viscosity at 210° F. (99° C.) of 46 SUS. In the preparation of the compositions containing 0.10 and 0.50 parts by weight antimony per 100 parts by weight catalyst O, the calculated amounts of a cyclohexane solution of the purified antimony tris(O,O-dipropyl phosphorodithioate) in mineral oil, as described above, were mixed with catalyst O, previously dried in a fluid bed at 900° F. (482° C.), the cyclohexane solution containing 0.0147 g antimony per ml solution. In each instance the treated catalyst was then heated to apparent dryness, after which the dried catalyst composition was transferred to a quartz reactor and heated to 900° F. (482° C.) as a bed fluidized with nitrogen, followed by regeneration at 1100° F. (593° C.) while fluidized with air. The catalyst composition was then preaged by processing it through ten cracking-regeneration cycles as a confined fluid bed in a quartz reactor using topped West Texas crude oil as feed. Each cycle consisted of a nominal 0.5-minute oil feed time to the catalyst fluidized with nitrogen during the cracking step conducted at about 950° F. (510° C.), followed by stripping of hydrocarbons from the system by fluidization of the catalyst for 3 to 5 minutes with nitrogen, followed by regeneration of the catalyst while heating to about 1200° F. (649° C.) for about 1 hour while fluidized with air. The catalyst was then cooled to room temperature (about 25° C.) while fluidized with nitrogen. The resulting catalyst containing 0.10 parts by weight antimony per 100 parts by weight catalyst O used in its preparation is herein designated as catalyst B-1, and the resulting catalyst containing 0.50 part by weight antimony per 100 parts by weight catalyst O is herein designated as catalyst B-2.

Although the procedures used in the preparation of catalysts O, A-1, A-2, B-1, and B-2 included some variations other than the use or lack of use of a particular modifying agent comprising antimony or the relative amount of such modifying agent, these other variations were not such as would be expected to have a significant effect on the results obtained in the subsequent evaluation of the catalysts in cracking tests.

Catalysts O, A-1, A-2, B-1, and B-2 were evaluated in three series of cracking-regeneration cycles, in which the cracking step was conducted over a range of catalyst:oil ratios, using approximately 35 g of catalyst as a confined fluid bed in a quartz reactor and employing topped West Texas crude oil as the feedstock in the cracking step. In each cycle the cracking step was carried out at 950° F. (510° C.) and about atmospheric pressure for 0.5 minute, and the regeneration step was conducted at about 1200° F. (649° C.) and about atmospheric pressure for approximately 1 hour using fluidizing air, the reactor being purged with nitrogen before and after each cracking step.

Properties of the topped West Texas crude oil used in this Example are shown in Table IV.

Table IV

| | |
|---|---|
| API gravity @ 60° F. (16° C.)[1] | 21.4 |
| Distillation, °F. (°C.)[2] | |
| IBP | 556 (291) |
| 10% | 803 (428) |
| 20% | 875 (468) |
| 30% | 929 (498) |
| 40% | 982 (528) |
| 50% | 1031 (555) |
| Carbon residue, Rams, wt %[3] | 5.5 |
| Elemental analysis | |
| S, wt % | 1.2 |
| Ni, ppm | 5.24 |
| V, ppm | 5.29 |
| Fe, ppm | 29 |
| Pour point, °F. (°C)[4] | 63 (17) |
| Kinematic viscosity, cSt[5] | |
| @ 180° F. (82° C.) | 56.5 |
| @ 210° F. (99° C.) | 32.1 |
| Refractive index @ 67° C.[6] | 1.5 |

[1]ASTM D 287-67
[2]ASTM D 1160-61
[3]ASTM D 524-64
[4]ASTM D 97-66
[5]ASTM D 445-65
[6]ASTM 1747-62

Typical results of the cracking tests are summarized in Table V. The catalyst:oil weight ratios and yields of gasoline, coke, and hydrogen at a feed conversion level of 75 volume percent were determined graphically from curves which were drawn to represent values for conversion and yields as determined experimentally at the various catalyst:oil ratios employed.

Table V

| Catalyst | Sb/100/wt Cat | Catalyst:Oil Wt. Ratio | Yield: Gasoline, Vol. % of Feed | Yield: Coke, Wt. % of Feed | Yield: $H_2$, SCF/bbl Feed Converted |
|---|---|---|---|---|---|
| 0 | — | 7.4 | 54.8 | 16.4 | 800 |
| A-1 | 0.11 crude | 7.3 | 58.8 | 12.5 | 440 |
| B-1 | 0.10 pure | 7.3 | 57.0 | 13.9 | 500 |
| A-2 | 0.54 crude | 7.4 | 63.2 | 12.0 | 384 |
| B-2 | 0.50 pure | 7.2 | 61.6 | 12.7 | 340 |

Thus, at the same feed conversion level, and at comparable antimony levels, the catalysts prepared by use of the crude antimony tris(O,O-dipropyl phosphorodithioate), when compared with the catalysts prepared by use of the purified antimony tris(O,O-dipropyl phosphorodithioate), provided higher gasoline yields and lower coke production and gave acceptably low levels of hydrogen which were much lower than those obtained with the catalyst to which no antimony had been added, at the same time exhibiting good catalyst activity. Although the antimony concentration in each of the catalysts which had been prepared by use of the crude antimony tris(O,O-dipropyl phosphorodithioate) was slightly higher than that in the corresponding catalyst prepared by use of the purified antimony tris(O,O-dipropyl phosphorodithioate), this minor difference in antimony concentration would have been responsible for, at most, only a minor portion of the increased gasoline yield and reduced coke production which was observed when the crude phosphorodithioate was used.

Reasonable variation and modification are possible within the scope of the foregoing disclosure and the appended claims to the invention the essence of which is that crude antimony tris(O,O-dihydrocarbyl phosphorodithioate), e.g., crude antimony tris(O,O-dipropyl phosphorodithioate), when used for applying antimony to a hydrocarbon cracking catalyst has yielded significantly higher gasoline yields and lower coke production than when the purified corresponding compound was used; and that therefore, a catalyst suitable for cracking hydrocarbon, e.g., hydrocarbon oil, has been provided upon which contaminating metal is passivated whenever it appears thereon and that a method for passivating said metal as well as a method for cracking a hydrocarbon, e.g., a hydrocarbon oil, with catalyst which has been so treated have been set forth as descrbed.

We claim:

1. A cracking catalyst suitable for cracking a hydrocarbon which has been treated to passivate a contaminating metal whenever it appears thereon by incorporating with said catalyst, a crude antimony tris(O,O-dihydrocarbyl phosphorodithioate).

2. A catalyst according to claim 1 wherein the antimony compound is represented by the formula $[(RO)_2PS_2]_3Sb$, wherein the R groups, which can be different, are hydrocarbyl radicals, each containing from 1 to about 18 carbon atoms.

3. A cracking catalyst according to claim 1 wherein the antimony compound is at least one compound selected from the compounds following: antimony tris(O,O-dimethyl phosphorodithioate), antimony tris(O,O-diethyl phosphorodithioate), antimony tris(O,O-dipropyl phosphorodithioate), antimony tris(O,O-diisobutyl phosphorodithioate), antimony tris(O,O-dihexyl phosphorodithioate), antimony tris[O,O-bis(2-ethyloctyl) phosphorodithioate], antimony tris(O,O-dipentadecyl phosphorodithioate), antimony tris(O-octadecyl O-cyclohexyl phosphorodithioate), antimony tris(O,O-dicylohexyl phosphorodithioate), antimony tris[O,O-bis(3-methylcyclopentyl) phosphorodithioate], antimony tris[O,O-bis(cyclopentylmethyl) phosphorodithioate], antimony tris(O,O-diphenyl phosphorodithioate), antimony tris(O,O-di-p-tolyl phosphorodithioate), antimony tris(O,O-dibenzyl phosphorodithioate), and antimony tris(O-butyl O-phenyl phosphorodithioate).

4. A catalyst according to claim 1 wherein the antimony compound is crude antimony tris(O,O-dipropyl phosphorodithioate).

* * * * *